US005108258A

United States Patent [19]

Gros

[11] Patent Number: 5,108,258

[45] Date of Patent: * Apr. 28, 1992

[54] SYSTEM FOR SUPPORTING THE ROTOR IN AN AXIAL EXHAUST TURBINE WITH AN EXHAUST END BEARING HAVING ISOTROPIC STIFFNESS AND DIRECTLY CONNECTED TO A FOUNDATION

[75] Inventor: Jean-Pierre Gros, Villemomble, France

[73] Assignee: GEC Alsthom SA, Paris, France

[ * ] Notice: The portion of the term of this patent subsequent to Apr. 21, 2009 has been disclaimed.

[21] Appl. No.: 515,023

[22] Filed: Apr. 26, 1990

[30] Foreign Application Priority Data

Apr. 26, 1989 [FR] France ..... 89 05544

[51] Int. Cl.[5] ..... G01D 25/00

[52] U.S. Cl. ..... 415/213.1; 415/220

[58] Field of Search ..... 415/213.1, 220, 221, 415/222, 223, 182.1, 170.1, 174.2; 417/360; 403/355, 356

[56] References Cited

U.S. PATENT DOCUMENTS

| | | | |
|---|---|---|---|
| 3,535,540 | 10/1970 | Boulogne | 415/221 |
| 3,881,843 | 5/1975 | Meylan | 415/213.1 |
| 4,050,660 | 9/1977 | Eggmann et al. | 415/213.1 |
| 4,076,452 | 2/1978 | Hartmann | 415/220 |
| 4,102,599 | 7/1978 | Ziegler | 415/221 |

FOREIGN PATENT DOCUMENTS

| | | |
|---|---|---|
| 1093144 | 12/1958 | Fed. Rep. of Germany . |
| 3243659 | 7/1983 | Fed. Rep. of Germany . |
| 1130410 | 2/1957 | France . |
| 2267455 | 11/1975 | France . |

*Primary Examiner*—Edward K. Look
*Assistant Examiner*—Hoang Nguyen
*Attorney, Agent, or Firm*—Sughrue, Mion, Zinn Macpeak & Seas

[57] ABSTRACT

The bearing supporting the rotor has its stiffness increased by being connected directly to a foundation, thereby providing better behavior for the bearing in the event of a major accident (e.g. the loss of one of the blades in the last, low pressure stage). In addition, by separating the bearing function from the stator exhaust end function, there is no danger of any rotor out-of-balance forces exciting resonance in the stator structure.

7 Claims, 3 Drawing Sheets

SYSTEM FOR SUPPORTING THE ROTOR IN AN AXIAL EXHAUST TURBINE WITH AN EXHAUST END BEARING HAVING ISOTROPIC STIFFNESS AND DIRECTLY CONNECTED TO A FOUNDATION

In a turbine, or a portion of a turbine having axial exhaust, one of the rotor-supporting bearings is integrated in the exhaust endpiece.

BACKGROUND OF THE INVENTION

This bearing is held in place by means of tie rods judiciously disposed in the exhaust endpiece and conveying both normal and accidental forces from the rotor to supporting lugs and to transverse stator centering means, the lugs and the stator transverse centering means bearing against a bed plate.

This constructional disposition allows a degree of weakness to appear. Proper dynamic behavior of the rotor and rotor safety relative to accidental large out-of-balance forces require the bearing to have a high degree of stiffness which is difficult to obtain using a system of tie rods.

In addition, each azimuth corresponds to a different stiffness and this makes it more difficult to support a line of shafts whenever large accidental dynamic out-of-balance forces occur.

All of the forces pass through the bearing or the clamp, the tie rods, the supporting lugs, the stator transverse centering means, and the bed plate.

In addition, the constant increase in the size of exhaust sections is giving rise to dynamic forces of ever increasing magnitude in stators of even bigger sizes.

Document FR-A 75 10810 teaches a gas turbine installation in which the bearing is held by two poles connected to the bed plate.

Such an installation will have poor dynamic behavior since forces are compensated in the vertical direction only while large forces in the horizontal direction will give rise to major deformation of the structure.

Finally, the poles are long and have insufficient stiffness to withstand large out-of-balance forces.

One of the aims of the support system of the invention defined by the claims is to increase the stiffness of the bearing supporting the rotor and to provide proper support for the bearing against major accidents (e.g. the loss of one of the last low pressure (LP) blades) under the best conditions possible. This result is even further improved when the stiffness of the bearing is isotropic.

SUMMARY OF THE INVENTION

The present invention provides a support system for supporting an axial exhaust turbine on a concrete bed plate in which the exhaust portion is provided with lugs placed on concrete stands fixed to the bed plate and is centered transversely by centering means bearing against the bed plate, the inside of said exhaust including a bearing supporting the turbine rotor, said bearing being supported by tie rods or arms radiating from the bearing, the support system including a wall fixed to the bed plate and provided with a circular opening through which the exhaust passes, and the tie rods or arms passing through the wall of the exhaust and being directly connected at their ends to anchor points fixed on the wall around the opening.

In addition, by taking the bearing function away from the stator, out-of-balance effects of the rotor cannot excite resonance in the stator structure.

BRIEF DESCRIPTION OF THE DRAWINGS

An embodiment of the invention is described by way of example with reference to the accompanying drawings, in which.

DETAILED DESCRIPTION

Figure 1:
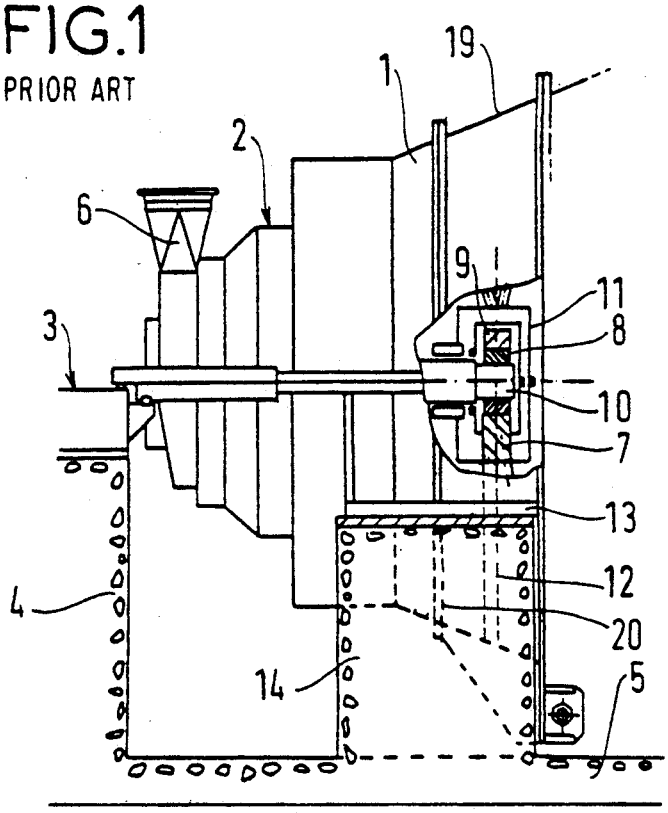
FIG.1 PRIOR ART
FIGS. 1 and 2 are respectively a side view and an end view of a prior art system for supporting the rotor of an axial exhaust turbine.
Figure 2:
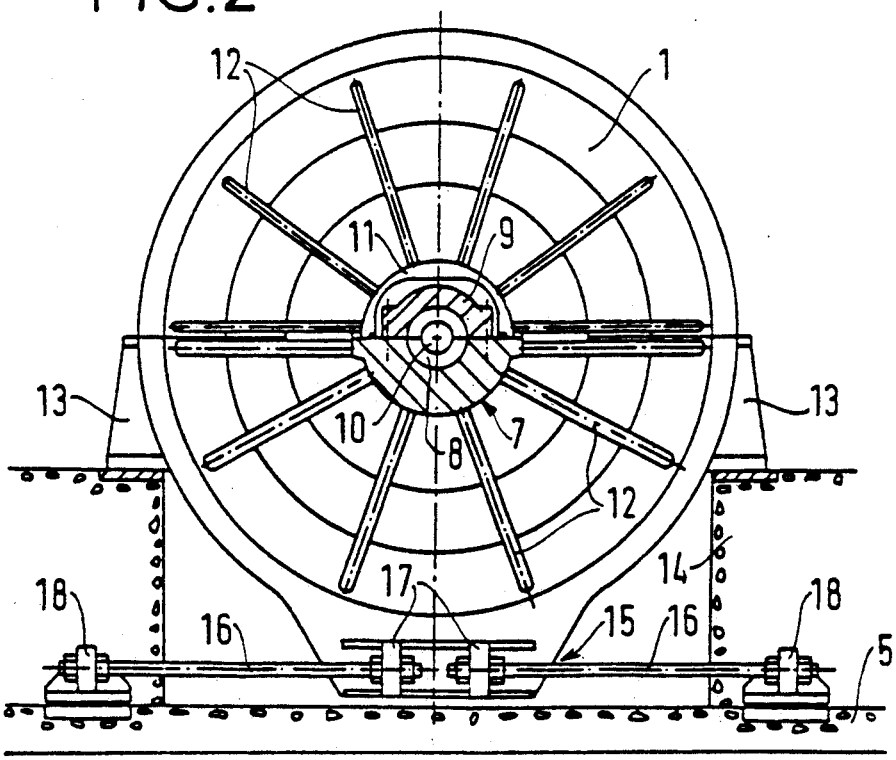
FIG.2 PRIOR ART
Figure 3:
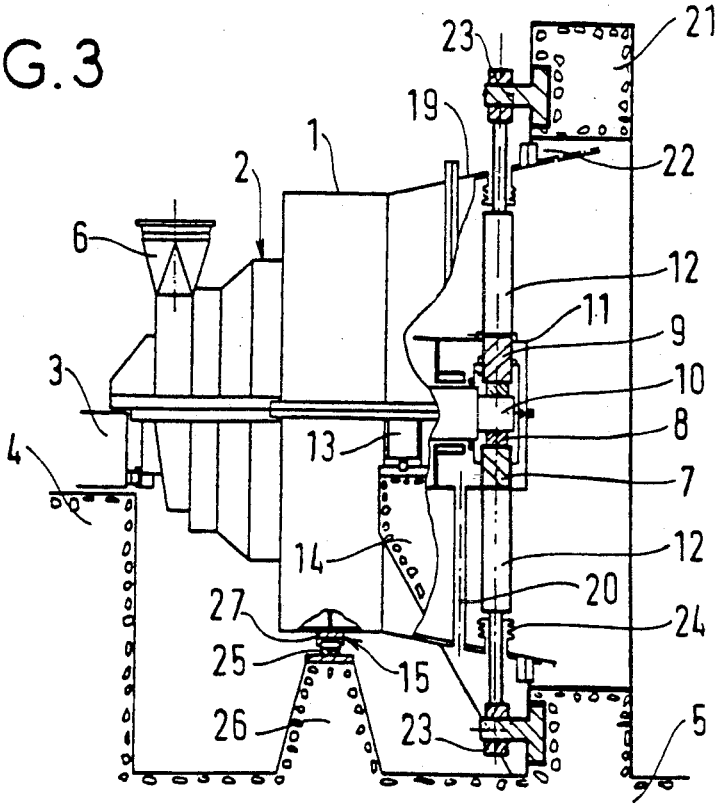
FIGS. 3 and 4 are respectively a side view and an end view of a rotor support system in accordance with the invention.
Figure 4:
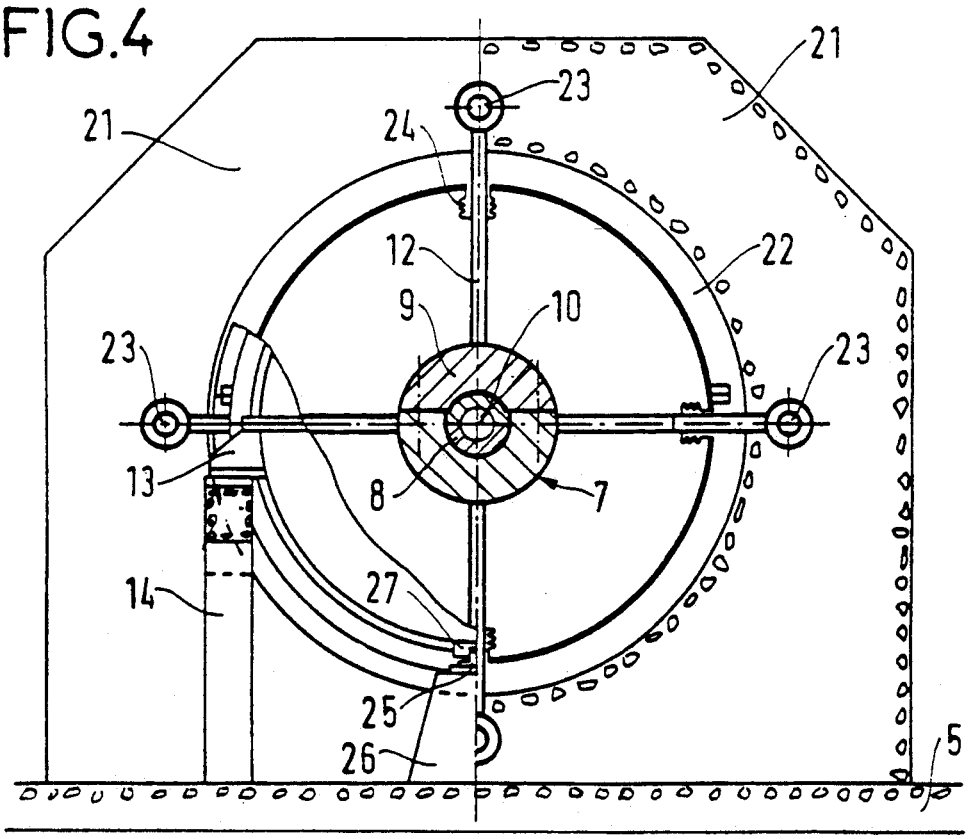
Figure 5:
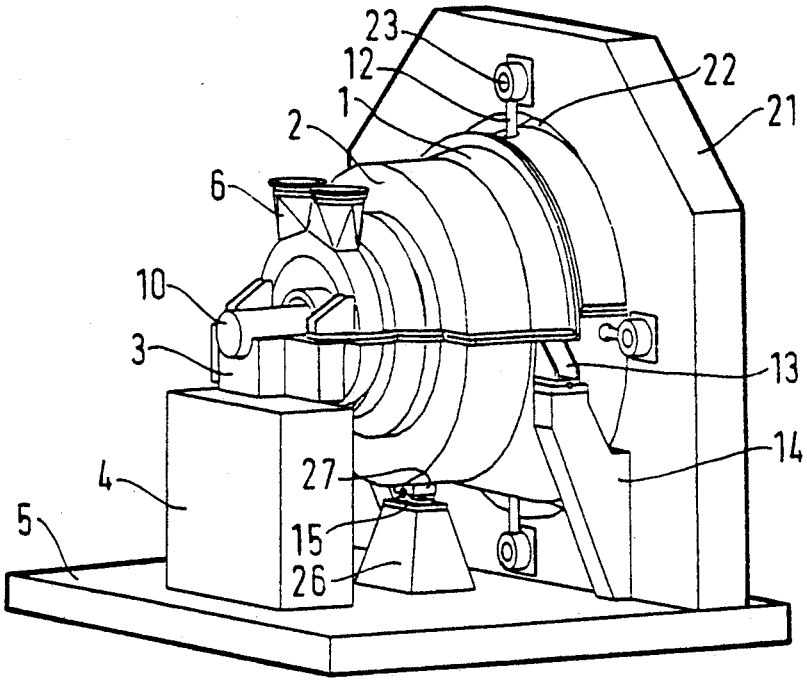
FIGS. 5 and 6 are perspective views of the rotor support system of FIGS. 3 and 4 seen from its admission end and from its exhaust end.
Figure 6:
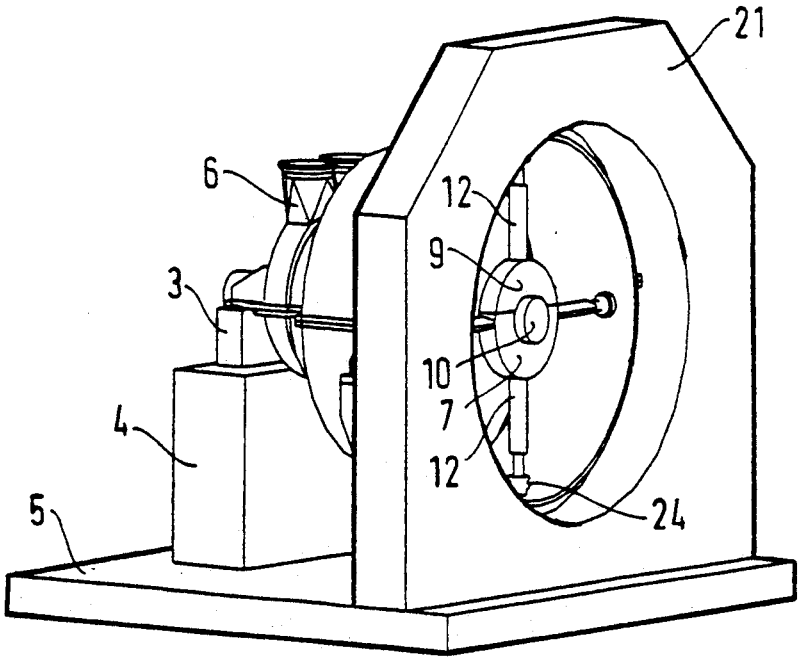

FIGS. 1 and 2 show a prior art turbine having an axial exhaust 1 forming a portion of its stator 2. The turbine includes a bearing 3 supported by a concrete stand 4 forming an admission end (6) portion of a concrete bed plate 5, and also having a bearing 7 at its exhaust end 1.

The bearing 7 comprises a shell 8 and a clamp 9 supporting the rotor 10, together with a steam shroud 11. The shroud 11 provides sealing between the steam and atmospheric pressure with which it is connected via a duct 20.

The bearing 7 is supported by tie rods 12 whose ends are fixed to the wall of the exhaust 1.

The exhaust 1 is provided with two side lugs 13 which stand on concrete stands 14 fixed to the bed plate 5.

A transverse centering device 15 is situated at the bottom of the exhaust. The device 15 includes two horizontal bars 16 each bolted at one end to a fastener 17 fixed to the bottom of the exhaust, and at the other end to a fastener 18 fixed to the concrete bed plate 5.

In order to facilitate access to the bearing 7 without it being necessary to disassemble the top portion of the stator 2, the exhaust 1 includes a removable half-part 19 which is held in place by two vertically extending half-flanges.

Both normal and accidental forces on the rotor 10 are conveyed by the tie rods 12 to the wall of the exhaust which in turn conveys them to the lugs 13 or to the centering device 15.

In the event of a large accidental out-of-balance force occurring in the prior art support system, there is a danger of the bearing 7 being damaged and of the support system itself being damaged, particularly when the parts concerned are very large in size.

In addition, the tie rods 12 distributed around the entire circumference inside the exhaust give rise to a relatively large amount of headloss.

The support system of the invention is shown in FIGS. 3 to 6. Portions which are similar to those of the prior art system are given the same references.

The turbine rotor 10 is supported by two bearings 3 and 7, one of them being situated at the admission end 6 and the other inside the axial exhaust 1.

The bearing 3 is supported by a concrete stand 4 on the concrete bed plate 5.

The bearing 7 includes a shell 8 having a clamp 9 fixed thereon and a steam shroud 11.

The shroud 11 is kept at atmospheric pressure by means of a duct 20.

According to the invention, a vertical concrete wall 21 is provided on the bed plate 5 and includes a circular hole 22 through which the exhaust 1 passes.

Four anchor points 23 are anchored on the wall 21 around the opening 22. The ends of four tie rods 12 (or more if so required for supporting the bearing 7) are removably fixed to these anchor points.

When there are four tie rods 12, they are disposed in a cross configuration having a vertical branch and a horizontal branch.

The tie rods 12 are provided with sealing bellows 24 where they pass through the wall of the exhaust 1.

The bottom portion of the exhaust 1 is fixed to the stator 2. It is provided with two side support lugs 13 which stand on concrete posts 14 supported by the bed plate 5.

The transverse centering device 15 for the stator 2 is situated at the exhaust end thereof. It comprises a key 25 mounted on a concrete stand 26 projecting from the bed plate 5, said key 25 being imprisoned in a slideway 27 extending parallel to the axis of the turbine and fixed to the exhaust.

The stands 4, 14, and 26, and the wall 21 are preferably made of concrete and are directly integrated with the bed plate 5, constituting, together therewith, a massive anchor block.

It is also possible to make these stands using a steel structure.

Bearing forces are no longer transmitted via the stator 2 and the exhaust 1 since the tie rods 12 are fixed to the concrete wall 21 directly. The system of the invention can therefore accept very large accidental out-of-balance forces while still retaining integrity of rotor support.

In addition, by distributing the tie rods 12 uniformly in azimuth, the best possible conditions are obtained for withstanding the accidental forces due to large out-of-balance forces.

The tie rods 12 required for transmitting these forces are much fewer in number than those required in the prior art system. Headlosses in the exhaust are thus minimized.

Finally, since the bearing 7 does not transmit forces to the exhaust 1, the stands 14 supporting the side lugs 13 may be much lighter in construction and the centering device 15 may be constituted merely by a key and keyway device.

Access to the exhaust end of the bearing is obtained by simultaneously removing the top half portion 19 and the vertical tie rod 12 which is itself connected to the clamp 9 of the bearing shell. Naturally, it is necessary to remove the tie rod 12 from its anchor point 23.

I claim:

1. In a support system for supporting a steam turbine having an axial exhaust on a concrete bed plate in which said exhaust is provided with lugs placed on concrete stands fixed to the bed plate and is centered transversely by centering means bearing against the bed plate, said exhaust including, inside thereof, a bearing supporting a turbine rotor, said bearing being supported by tie rods fixed at one end to the bearing and radiating from the bearing, the improvement further including an upright wall fixed to the bed plate and provided with a circular opening and said exhaust passes axially through said opening, and the tie rods pass through the wall of the exhaust and being directly connected at other ends thereof to anchor points fixed on the wall, around the opening.

2. A support system according to claim 1, wherein the tie rods are uniformly distributed around the bearing.

3. A support system according to claim 2, wherein said tie rods comprise two vertical tie rods and two horizontal tie rods in a cross-configuration.

4. A support system according to claim 1, wherein the points where the tie rods pass through the wall of the exhaust are provided with expansion bellows sealing the tie rods to said exhaust.

5. A support system according to claim 1, wherein the exhaust is centered transversely on said concrete bed plate by means of a key and keyway mounted to said bed plate and said exhaust, respectively.

6. A support system according to claim 1, wherein the upright wall is made of concrete.

7. A support system according to claim 1, including a steam shroud fixed to the bearing to provide sealing between the exhaust steam and atmospheric pressure.

* * * * *